US005155463A

United States Patent [19]

Ueda

[11] Patent Number: 5,155,463

[45] Date of Patent: Oct. 13, 1992

[54] THERMAL PROTECTOR

[75] Inventor: Kensaku Ueda, Otsu, Japan

[73] Assignee: Matsushita Electric Industrial Co., Ltd., Osaka, Japan

[21] Appl. No.: 707,482

[22] Filed: May 30, 1991

[30] Foreign Application Priority Data

Jun. 1, 1990 [JP] Japan ..... 2-144785

[51] Int. Cl.[5] ..... H01H 45/02; H01H 37/04; H01H 71/16

[52] U.S. Cl. ..... 337/112; 337/380; 313/623; 445/26

[58] Field of Search ..... 337/112, 107, 102, 16, 337/380; 313/619, 623, 625, 626; 315/73; 445/26, 44; 361/105, 106

[56] References Cited

U.S. PATENT DOCUMENTS 3,568,310 3/1971 Neuber ..... 445/44
4,866,341 9/1989 Ichiga et al. ..... 313/623
4,937,494 6/1990 Dunn ..... 313/623

FOREIGN PATENT DOCUMENTS 0401403 12/1990 European Pat. Off. ..... 313/623
56-42912 10/1981 Japan .
658187 10/1951 United Kingdom .
2169441A 7/1986 United Kingdom .

*Primary Examiner*—Harold Broome
*Attorney, Agent, or Firm*—Panitch, Schwarze, Jacobs & Nadel

[57] ABSTRACT

An electrode mount with a stationary electrode and a movable electrode facing each other, the movable electrode including a snap-acting and thermosensitive element which comes into contact with and out of contact with the stationary electrode, fixed thereon by a frit glass bead is encased in a glass envelope having an opening at one end thereof. A sealed portion for sealing the frit glass bead and the opening of the glass envelope is formed by melting frit glass therebetween.

1 Claim, 1 Drawing Sheet

THERMAL PROTECTOR

BACKGROUND OF THE INVENTION

1. Field of the Invention

The present invention relates to a thermal protector used in various electric components and appliances for the purpose of protecting them from burning due to overheating and over-current accidents.

2. Description of the Prior Art

This kind of conventional thermal protector has been so constructed that an electrode mount with a movable electrode and a stationary electrode facing each other fixed thereon by a glass bead is encased in a glass envelope, the opening of the glass envelope located under the glass bead is melted by heating to conduct pinch-sealing thereof, and then the glass envelope is exhausted and filled with an inactive gas, after which the top of the glass envelope undergoes tip-off to complete a hermetic sealing (Japanese Utility Model Publication No. 56-42912, FIG. 2(*a*)).

Such a thermal protector is attached to the temperature risen location of various electric components and appliances and has a protective function as follows; when overheating or over-current occurs at the location due to something unusual, the snap-acting and thermo-sensitive element of a movable electrode reverses to separate from a stationary electrode, which interrupts the flow of electric current to the electric components and appliances.

With this kind of thermal protector, there has arisen a demand for the development of a thermal protector having a more miniaturized structure because of the trend toward miniaturization in various electric components and appliances. However, it has been difficult to miniaturize a conventional thermal protector in terms of its structure, because in a conventional structure, the shapes and the dimensions of a glass bead or a pinch-sealed portion, the distances between a glass bead and the internal surface of a glass envelope or between a glass bead and the internal surface of a pinch-sealed portion, etc., have been limited due to problems associated with hermetic sealing and glass crack.

SUMMARY OF THE INVENTION

The thermal protector of this invention, which overcomes the above-discussed and numerous other disadvantages and deficiencies of the prior art, comprises:

a movable electrode facing a stationary electrode and including a snap-acting and thermosensitive element which comes into contact with and out of contact with the stationary electrode, an electrode mount with the stationary electrode and the movable electrode fixed thereon by a frit glass bead;

a glass envelope which has an opening at one end thereof and in which the electrode mount is encased; and a sealed portion for sealing the frit glass bead and the opening of the glass envelope, formed by melting frit glass therebetween.

In a preferred embodiment, the frit glass bead consists of a material crystallized by pressed sintering.

In a preferred embodiment, a protruding portion is formed on the underside of the frit glass bead, two insertion openings are provided on the frit glass bead through the protruding portion, and the movable electrode and the stationary electrode are separately inserted into each insertion opening.

Thus, the invention described herein makes possible the objective of providing a miniature thermal protector having almost the same level of electric rating as that of conventional one without causing burning even when used in various electric components and appliances.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
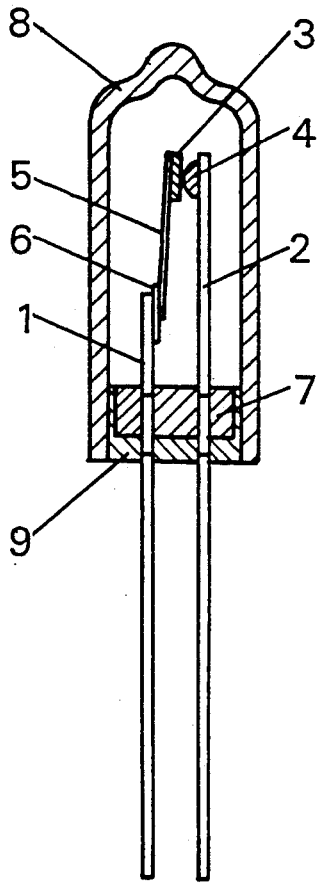
FIG. 1 shows a partially cutaway front view of a thermal protector as an example of the present invention.
Figure 2:
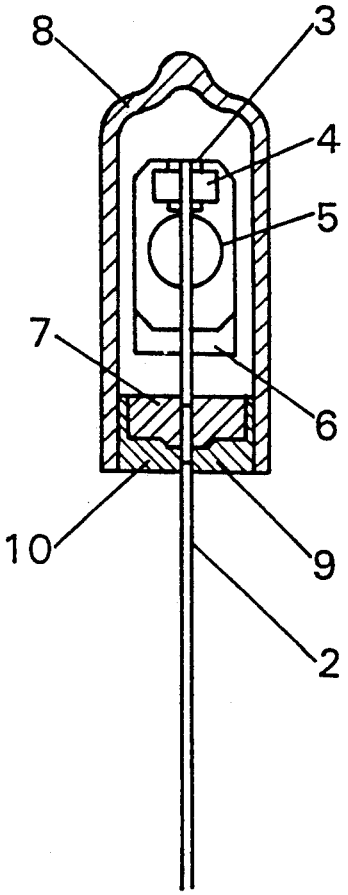
FIG. 2 shows a partially cutaway side view of the thermal protector.
Figure 3:
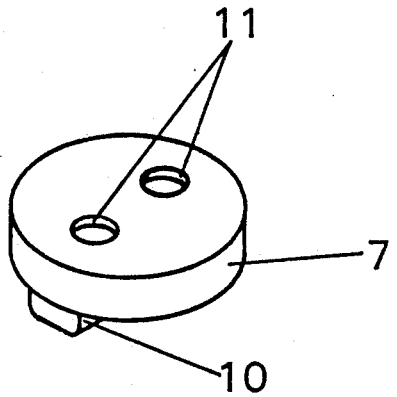
FIG. 3 shows a perspective view of a frit glass bead used for the thermal protector.

As shown in FIGS. 1 and 2, in a thermal protector as an example of the present invention, a movable electrode comprises a snap-acting and thermosensitive element 5 with a contact 3 fixed by welding on the tip thereof, a metal plate 6 the one edge of which is welded to an edge of the element, and a movable electrode lead wire 1 welded to another edge of the metal plate. A stationary electrode comprises a stationary electrode lead wire 2 with a contact 4 fixed by welding thereon, the contact 4 being located so as to cross contact with the contact 3 under prescribed contact pressure. The movable electrode and the stationary electrode face each other and combined by a frit glass bead 7 which has been crystallized by pressed sintering so as to have mechanical and thermal strength to constitute an electrode mount. A protruding portion 10 having two insertion openings 11 is formed on the underside of a frit glass bead 7 (see FIG. 3), each electrode lead wire is separately inserted into these insertion openings, and then the protruding portion 10 is melted by means of a burner, etc., to seal each electrode lead wire in the insertion opening 11 of the frit glass bead 7.

The electrode mount thus obtained is encased in a glass envelope 8, and then the space between the opening of the glass envelope 8 and the frit glass bead 7 is charged with boric lead silicate glass type frit glass paste having a low melting point. After drying the paste by hot air, the paste is melted by heating with a burner, etc., to perform hermetic sealing of the opening of the glass envelope 8 and the frit glass bead 7, thereby forming a sealed portion 9.

Thereafter, the air in the glass envelope 8 is exhausted, and then clean dry air is sealed therein, followed by tip-off of the glass envelope 8.

Since in the thermal protector having the aforesaid structure of the present invention, the opening of the glass envelope 8 and the frit glass bead 7 combining the stationary electrode and the movable electrode are sealed by melting frit glass therebetween to form the sealed portion 9, the length of the glass envelope 8 can be shortened as compared with a conventional thermal protector in which the opening of a glass envelope located under a glass bead is softened by heating to be sealed. In addition, since the aforesaid sealing can be conducted at lower temperatures, the distance between the sealed portion 9 of the glass envelope 8 and the snap-acting and thermo-sensitive element 5 can be shortened as compared with the aforesaid conventional thermal protector. Consequently, the overall length of the glass envelope 8 can further be shortened, thereby achieving the miniaturization of a thermal protector. Also, the sealing process can be performed at lower temperatures, thereby employing a very simple production line. This lowers the cost of manufacturing a thermal protector coupled with a cut in the amount of materials due to miniaturization.

Figure 4:
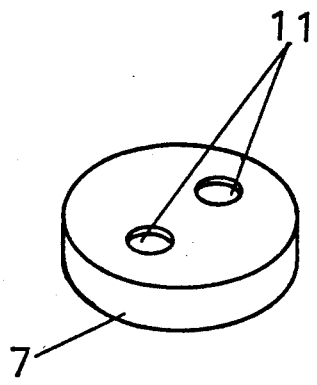
FIG. 4 shows a perspective view of another example of the frit glass bead used for the thermal protector.

FIG. 4 shows another example of a frit glass bead, which has no protruding portion and can be melted to seal each electrode lead wire therein by means of a burner, etc.

A thermal protector having a structure shown in FIGS. 1 and 2 and the same dimensions as those shown in Table 1 (a sample of the present invention) was manufactured. Then, various kinds of tests were conducted, indicating the results shown in Table 2.

In these tables, a sample with a conventional structure shows the aforesaid thermal protector having a structure as shown in FIG. 2(*a*) of Japanese Utility Model Publication No. 56-42912.

TABLE 1

| Envelope | Dimension | Sample with a conventional structure | Sample of the present invention |
|---|---|---|---|
| Glass | Max-diameter (mm) | 8 (100) | 6.2 (78) |
| | Total length (mm) | 34.5 (100) | 18 (52) |
| | Outer volume ($mm^3$) | 1530.7 (100) | 543.2 (36) |

( ): Relative percent

TABLE 2

| | Test item | Number of samples tested | Sample with a conventional structure | Sample of the present invention |
|---|---|---|---|---|
| Heat shock | 100° C., 0° C. *1 Each immersion for 60 sec. | 10 | Rate of acceptable sample 100% | Rate of acceptable sample 100% |
| | 0° C., 180° C., 0° C. *2 Each immersion for 15 sec. | 10 | 100 | 100 |
| Helium leak | | 10 | 100 | 100 |
| Falling trip temperature to 3 amperes (°C.) | | 5 | 20 | 20 |
| Switchings | AC100-200V5A Power factor 0.5 | 5 | Average 10000 times | Average 10000 times |

Each sample is a high sensitive prototype with an operating temperature of 100° C.
*1 Boiling water and ice water
*2 Ethylene glycol As is apparent from Tables 1 and 2, a thermal protector of the present invention maintained the same quality as a conventional thermal protector and reduced the volume percent by as much as 64% compared with a conventional thermal protector, thereby largely miniaturizing a thermal protector.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A thermal protector comprising:

a movable electrode facing a stationary electrode and including a snap-acting and thermo-sensitive element which comes into contact with and out of contact with said stationary electrode, an electrode mount with said stationary electrode ad said movable electrode fixed thereon by a frit glass bead which comprises a material crystallized by pressed sintering;

a glass enveloper which has an opening at one end thereof and in which said electrode mount is encased;

a low melting frit glass paste charged between the opening of the glass envelope and said frit glass bead to seal said opening and said bead, said paste comprising a boric lead silicate glass; and a protruding portion formed on the underside of said frit glass bead with two insertion openings provided in said frit glass bead through said protruding portion, said movable electrode and said stationary electrode being inserted in separate insertion openings.

* * * * *